US010294943B2

(12) United States Patent
Rosson et al.

(10) Patent No.: US 10,294,943 B2
(45) Date of Patent: May 21, 2019

(54) SCROLL COMPRESSOR WITH A LUBRICATION ARRANGEMENT

(71) Applicant: DANFOSS COMMERCIAL COMPRESSORS, Trevoux (FR)

(72) Inventors: Yves Rosson, Villars les Dombes (FR); Patrice Bonnefoi, Saint Didier au Mont D'or (FR); Ingrid Claudin, Villars les Dombes (FR)

(73) Assignee: Danfoss Commercial Compressors, Trevoux (FR)

( * ) Notice: Subject to any disclaimer, the term of this patent is extended or adjusted under 35 U.S.C. 154(b) by 67 days.

(21) Appl. No.: 15/310,572

(22) PCT Filed: Jan. 27, 2015

(86) PCT No.: PCT/EP2015/051549
§ 371 (c)(1),
(2) Date: Nov. 11, 2016

(87) PCT Pub. No.: WO2015/172895
PCT Pub. Date: Nov. 19, 2015

(65) Prior Publication Data

US 2017/0074267 A1 Mar. 16, 2017

(30) Foreign Application Priority Data

May 16, 2014 (FR) ..... 14 54427

(51) Int. Cl.
*F01C 1/02* (2006.01)
*F03C 2/00* (2006.01)
(Continued)

(52) U.S. Cl.
CPC ..... *F04C 29/023* (2013.01); *F01C 21/02* (2013.01); *F04C 18/0215* (2013.01);
(Continued)

(58) Field of Classification Search
CPC ..... F01C 21/02; F04C 29/023; F04C 29/028; F04C 18/0223; F04C 18/0215;
(Continued)

(56) References Cited

U.S. PATENT DOCUMENTS 4,065,279 A * 12/1977 McCullough ..... F01C 1/0215 418/55.4
4,629,403 A 12/1986 Wood
(Continued)

FOREIGN PATENT DOCUMENTS

EP 0 227 880 A1 7/1987
EP 1 818 540 A1 8/2007
(Continued)

OTHER PUBLICATIONS

International Search Report for PCT Serial No. PCT/EP2015/051549 dated Mar. 20, 2015.

*Primary Examiner* — Theresa Trieu
(74) *Attorney, Agent, or Firm* — McCormick, Paulding & Huber LLP

(57) ABSTRACT

The scroll compressor (1) includes an orbiting scroll arrangement (7), and a drive shaft (18) configured to drive the orbiting scroll arrangement (7) in an orbital movement, the drive shaft (18) including a lubrication channel (32) and a first lubrication hole (35) fluidly connected to the lubrication channel (32) and emerging in an outer wall of the drive shaft (18). The scroll compressor (1) further includes a first and a second bearings (38, 39) axially offset along a rotation axis of the drive shaft (18) and each configured to engage the drive shaft (18). The first and second bearings (38, 39) and the drive shaft (18) partially define a first annular gap (44) in which emerges the first lubrication hole (35). The first bearing (38) and the drive shaft (18) define a first oil recess fluidly connected to the first annular gap (44),
(Continued)

and the second bearing (39) and the drive shaft (18) define a second oil recess fluidly connected to the first annular gap (44).

20 Claims, 6 Drawing Sheets

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 29/02*** | (2006.01) |
| ***F01C 21/02*** | (2006.01) |
| ***F04C 18/02*** | (2006.01) |

(52) U.S. Cl.
CPC ..... *F04C 18/0223* (2013.01); *F04C 29/028* (2013.01); *F04C 2240/50* (2013.01); *F04C 2240/56* (2013.01); *F04C 2240/603* (2013.01)

(58) Field of Classification Search
CPC F04C 23/008; F04C 2240/56; F04C 2240/50; F04C 2240/603
USPC ..... 418/55.1–55.6, 57, 88, 94, 102
See application file for complete search history.

(56) References Cited

U.S. PATENT DOCUMENTS

| | | | | |
|---|---|---|---|---|
| 4,811,471 | A | 3/1989 | Etemad et al. | |
| 7,766,633 | B2 * | 8/2010 | Nakamura | F04C 23/008 418/94 |
| 8,475,149 | B2 * | 7/2013 | Kakuda | F04C 23/008 418/55.1 |
| 2011/0194965 | A1 | 8/2011 | Yamada et al. | |

FOREIGN PATENT DOCUMENTS

| | | | | |
|---|---|---|---|---|
| JP | H06-173954 | A | 6/1994 | |
| WO | WO 2014191282 | A1 * | 12/2014 | F04C 29/005 |

* cited by examiner

SCROLL COMPRESSOR WITH A LUBRICATION ARRANGEMENT

CROSS REFERENCE TO RELATED APPLICATION

This application is entitled to the benefit of and incorporates by reference subject matter disclosed in the International Patent Application No. PCT/EP2015/051549 filed on Jan. 27, 2015 and French Patent Application No. 14/54427 filed on May 16, 2014.

TECHNICAL FIELD

The present invention relates to a scroll compressor, and in particular to a scroll refrigeration compressor.

BACKGROUND

As known, a scroll compressor may include:

a closed container, a compression unit configured to compress refrigerant and including a fixed scroll and an orbiting scroll, a drive shaft configured to drive the orbiting scroll in an orbital movement, the drive shaft including notably:

a lubrication channel configured to be supplied with oil from an oil sump by an oil pump driven by the drive shaft, the lubrication channel extending over at least a part of a length of the drive shaft, and lubrication holes fluidly connected to the lubrication channel and emerging in an outer wall of the drive shaft, the lubrication holes being axially offset along the rotation axis of the drive shaft, a driving unit coupled to the drive shaft and arranged for driving in rotation the drive shaft about a rotation axis, and bearings axially offset along the rotation axis of the drive shaft and each configured to engage the drive shaft.

During rotation of the drive shaft, the lubrication channel is supplied with oil by the oil pump, and the supplied oil is then fed, through centrifugal force and via the lubrication holes, to bearing surfaces of the bearings, which leads to a lubrication of the latter.

In order to ensure a satisfactory lubrication of the bearings, the drive shaft is preferably provided with one lubrication hole in front of each bearing, and each lubrication hole preferably emerges in an inner wall portion of the lubrication channel opposite to the rotation axis of the drive shaft such that the oil supplied in the lubrication channel flows by centrigugation along said inner wall portion and easily enters the lubrication holes through centrifugal force.

However, the final angular location of the lubrication holes depends on the angular location of the radial loads applied between the drive shaft and the bearings during rotation of the drive shaft. Indeed, if the lubrication holes are located at the same angular location than that of the radial loads applied between the drive shaft and the bearings, then the pressure created by said radial loads at each lubrication hole will prevent exit of oil from the corresponding lubrication hole, which will impede a satisfactory lubrication of the bearings.

Therefore, the appropriate angular location of the lubrication holes with respect to said inner wall portion of the lubrication channel cannot always be respected, which leads to a decrease of the bearings lubrication quality.

Further, as the angular location of the radial loads applied between the drive shaft and the bearings depends on the drive shaft speed, in addition to the operating conditions, the use of a variable-speed motor as driving unit may render difficult the selection of the most appropriate angular location for the lubrication holes.

SUMMARY

It is an object of the present invention to provide an improved refrigeration compressor which can overcome the drawbacks encountered in conventional scroll compressors.

Another object of the present invention is to provide a scroll compressor whose the drive shaft bearings can be optimally lubricated.

According to the invention such a scroll compressor includes at least:

a compression unit configured to compress refrigerant and including at least a first fixed scroll and an orbiting scroll arrangement, a drive shaft configured to drive the orbiting scroll arrangement in an orbital movement, the drive shaft including at least:

a lubrication channel configured to be supplied with oil from an oil sump and extending over at least a part of a length of the drive shaft, and a first lubrication hole fluidly connected to the lubrication channel and emerging in an outer wall of the drive shaft, a driving unit coupled to the drive shaft and arranged for driving in rotation the drive shaft about a rotation axis, and a first and a second bearings axially offset along the rotation axis of the drive shaft and each configured to engage the drive shaft, wherein the first and second bearings and the drive shaft at least partially define a first annular gap, the first lubrication hole emerges in the first annular gap, the first bearing and the drive shaft define therebetween a first oil recess fluidly connected to the first annular gap, and the second bearing and the drive shaft define therebetween a second oil recess fluidly connected to the first annular gap.

During rotation of the drive shaft, the oil entering the lubrication channel is at least partially supplied to the first annular gap via the first lubricating hole, and then enters the first and second oil recesses. These provisions ensure an optimal lubrication of the first and second bearings whatever the angular location of the first lubricating hole and of the radial loads applied between the drive shaft and the first and second bearings, and whatever the rotational speed of the drive shaft.

Further, the first and second oil recesses maintain pressurized oil close to the first and second bearings, which avoids or limits the bearing depressurization, that is a cleaning of the bearings oil by the refrigerant.

Furthermore, the configuration of the drive shaft and the first and second bearings ensures an optimal lubrication of the first and second bearings even if the oil is supplied to the lubrication channel by a centrigugal pump. This leads to a less expensive scroll compressor.

According to an embodiment of the invention, the drive shaft further includes a first and a second outer surface portions substantially flat and facing, i.e. extending along, respectively the first and second bearings, the first outer surface portion and the first bearing defining the first oil recess, and the second outer surface portion and the second bearing defining the second oil recess.

According to an embodiment of the invention, the first and second outer surface portions extend substantially parallely to the rotation axis of the drive shaft.

According to an embodiment of the invention, the drive shaft includes a first outer flat part forming the first and second outer surface portions, the first outer flat part further extending along the first annular gap.

According to an embodiment of the invention, the first outer flat part extends substantially parallely to the rotation axis of the drive shaft.

According to an embodiment of the invention, the first lubrication hole is angularly offset from at least one of the first and second outer surface portions with respect to the rotation axis of the drive shaft.

According to an embodiment of the invention, the first lubrication hole emerges in an outer portion of the drive shaft angularly offset from the first outer flat part.

According to an embodiment of the invention, the first lubrication hole is substantially aligned with the first and second outer surface portions in a direction extending parallely to the rotation axis of the drive shaf.

According to an embodiment of the invention, the first lubrication hole emerges in the first outer flat part.

According to an embodiment of the invention, the lubrication channel is offset from the rotation axis of the drive shaft, the first lubrication hole emerging in a first inner wall portion of the lubrication channel opposite to the rotation axis of the drive shaft with respect to the longitudinal axis of the lubrication channel, and more precisely in a first inner wall portion of the lubrication channel along which the oil flows by centrifugation during rotation of the drive shaft.

According to an embodiment of the invention, the first outer flat part is angularly located substantially at the opposite of an angular location of radial loads applied between the drive shaft and the first and second bearings during rotation of the drive shaft.

According to an embodiment of the invention, the first and second bearings are each configured to further engage one of the first fixed scroll and the orbiting scroll arrangement.

In other words, each of the first and second bearings is provided between the drive shaft and one of the first fixed scroll and the orbiting scroll arrangement.

According to an embodiment of the invention, the first lubrication hole extends substantially radially with respect to the rotation axis of the drive shaft.

According to an embodiment of the invention, the scroll compressor further includes a third and a fourth bearings axially offset along the rotation axis of the drive shaft and each configured to engage the drive shaft, the third and fourth bearings and the drive shaft at least partially defining a second annular gap, and wherein the drive shaft further includes a second lubrication hole fluidly connected to the lubrication channel and emerging in the second annular gap.

According to an embodiment of the invention, the third bearing and the drive shaft define a third oil recess fluidly connected to the second annular gap, and the fourth bearing and the drive shaft define a fourth oil recess fluidly connected to the second annular gap.

According to an embodiment of the invention, the drive shaft further includes a third and a fourth outer surface portions substantially flat and facing respectively the third and fourth bearings, the third outer surface portion and the third bearing defining the third oil recess, and the fourth outer surface portion and the fourth bearing defining the fourth oil recess.

According to an embodiment of the invention, the third and fourth bearings are each configured to further engage the other one of the first fixed scroll and the orbiting scroll arrangement.

According to an embodiment of the invention, the drive shaft includes at least a driving portion configured to drive the orbiting scroll arrangement in an orbital movement, and a first guided portion.

According to an embodiment of the invention, the first and second bearings are arranged to rotatably guide and support the first guided portion of the drive shaft.

According to an embodiment of the invention, the drive shaft further includes a second guided portion, the first and second guided portions being located on either side of the driving portion.

According to an embodiment of the invention, the third and fourth bearings are arranged to engage the driving portion of the drive shaft.

According to an embodiment of the invention, the drive shaft extends across the orbiting scroll arrangement such that the first and second guided portions are respectively located on either side of the orbiting scroll arrangement.

According to an embodiment of the invention, the drive shaft further includes a third lubrication hole fluidly connected to the lubrication channel and emerging in an outer wall of the second guided portion of the drive shaft.

According to an embodiment of the invention, the drive shaft further includes a first end portion and a second end portion opposite to the first end portion, the first end portion including a central recess and having an external diameter larger than an external diameter of the second end portion. This arrangement of the first end portion of the drive shaft improves the rigidity of the drive shaft without increasing the deflection of the drive shaft. As the drive shaft is more rigid, its first eigen frequency is shifted to a higher level.

According to an embodiment of the invention, the central recess emerges in an end face of the first end portion of the drive shaft.

According to an embodiment of the invention, the external diameter of the first end portion corresponds to the largest external diameter of the drive shaft, and the external diameter of the second end portion corresponds to the smallest external diameter of the drive shaft.

According to an embodiment of the invention, the driving unit includes a motor having a stator and a rotor, the rotor being fitted on the first end portion of the drive shaft.

According to an embodiment of the invention, the drive shaft further includes a vent channel fluidly connected to the lubrication channel. The presence of the vent channel ensures the degassing of the oil circulating in the lubrication channel, and particularly the discharge of the refrigerant originating from the degassing outside the drive shaft. Such a degassing prevents a degradation of the bearing lubrication by the refrigerant.

According to an embodiment of the invention, the vent channel includes a flow restriction area configured to restrict the flow cross-section of the vent channel. Said flow restriction area prevents or limits the oil discharge, or oil leaks, through the vent channel, even when the oil quantity in the lubrication channel is particularly considerable and notably at high speed rotation of the drive shaft. This provision improves the compressor efficiency.

According to an embodiment of the invention, the flow restriction area is configured to radially restrict the flow cross-section of the vent channel.

According to an embodiment of the invention, the flow restriction area is configured such that, at the flow restriction area, a width of the flow cross-section of the vent channel is smaller than a height of the flow cross-section of the vent channel. Said configuration of the flow restriction area limits the oil discharge through the vent channel while ensuring an appropriate oil degassing.

According to an embodiment of the invention, the flow restriction area is located nearby an inner wall portion of the lubrication channel.

According to an embodiment of the invention, the flow restriction area is substantially centered with respect to rotation axis of the drive shaft.

According to an embodiment of the invention, the vent channel includes at least a first vent portion extending substantially radially relative to the rotation axis of the drive shaft, the flow restriction area being provided on the first vent portion. Said configuration of the vent channel eases the oil degassing.

According to an embodiment of the invention, the first vent portion includes a first section provided upstream the flow restriction area and a second section provided downstream the flow restriction area.

According to an embodiment of the invention, the vent channel includes a second vent portion located downstream the first vent portion and extending substantially parallelly to the rotation axis of the drive shaft.

According to an embodiment of the invention, the second vent portion is located substantially at the opposite of the first inner wall portion of the lubrication channel, i.e. the inner wall portion along which the oil flows by centrifugation during rotation of the drive shaft, with respect to the rotation axis of the drive shaft.

According to an embodiment of the invention, the vent channel emerges in a second inner wall portion of the lubrication channel located nearby the rotation axis of the drive shaft.

In other words, the vent channel emerges in a second inner wall portion of the lubrication channel turned towards the rotation axis of the drive shaft.

According to an embodiment of the invention, the vent channel is fluidly connected to the central recess of the first end portion of the drive shaft.

According to an embodiment of the invention, the drive shaft further includes a closure member configured to partially define the vent channel.

According to an embodiment of the invention, the closure member is configured to close an end portion of the lubrication channel.

According to an embodiment of the invention, the closure member includes a restriction member configured to partially define the flow restriction area.

According to an embodiment of the invention, the closure member includes a vent hole at least partially defining the vent channel. For example, the vent hole may form the second vent portion of vent channel.

According to an embodiment of the invention, the vent hole emerges in the central recess of the first end portion of the drive shaft.

According to an embodiment of the invention, the lubrication channel is substantially parallel to the rotation axis of the drive shaft.

According to an embodiment of the invention, the lubrication channel is stepped and includes a first channel portion configured to be supplied with oil from the oil sump and a second channel portion having an inner diameter larger than an inner diameter of the first channel portion.

According to an embodiment of the invention, the lubrication channel is arranged to be supplied with oil from the oil sump by an oil pump driven by the drive shaft.

According to an embodiment of the invention, the first fixed scroll includes a first fixed spiral wrap, and the orbiting scroll arrangement includes a first orbiting spiral wrap, the first fixed spiral wrap and the first orbiting spiral wrap forming a plurality of first compression chambers.

According to an embodiment of the invention, the compression unit further includes a second fixed scroll including a second fixed spiral wrap, the first and second fixed scrolls defining an inner volume, the orbiting scroll arrangement being disposed in the inner volume and further including a second orbiting spiral wrap, the second fixed spiral wrap and the second orbiting spiral wrap forming a plurality of second compression chambers.

According to an embodiment of the invention, the first and second orbiting spiral wraps are respectively provided on first and second faces of a common base plate, the second face being opposite to the first face.

According to an embodiment of the invention, the scroll compressor further includes at least a fifth bearing configured to engage the drive shaft and the second fixed scroll.

According to an embodiment of the invention, the fifth bearing is configured to rotatably guide and support the second guided portion of the drive shaft.

According to an embodiment of the invention, the scroll compressor further includes a first counterweight and a second counterweight connected to the drive shaft, the first and second counterweights being located respectively on either side of the orbiting scroll arrangement. This arrangement of the first and second counterweights allows to balance the mass of the orbiting scroll arrangement with a limited tilting of the drive shaft. Such a limited tilting of the drive shaft improves the bearings reliability and the driving unit reliability, and therefore the compressor reliability and performance.

According to an embodiment of the invention, the scroll compressor is a vertical scroll compressor and the drive shaft extends substantially vertically.

According to an embodiment of the invention, the drive shaft is a stepped drive shaft. This arrangement ensures an easy assembly of the scroll compressor. According to an embodiment of the invention, the stepped drive shaft includes at least four different diameters, in order to facilitate compressor assembly and to limit the shaft deflection/to sustain deformation at high speeds.

According to an embodiment of the invention, the scroll compressor is a variable-speed scroll compressor.

According to another embodiment of the invention, the scroll compressor is a fixed-speed scroll compressor.

These and other advantages will become apparent upon reading the following description in view of the drawing attached hereto representing, as non-limiting examples, three embodiments of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
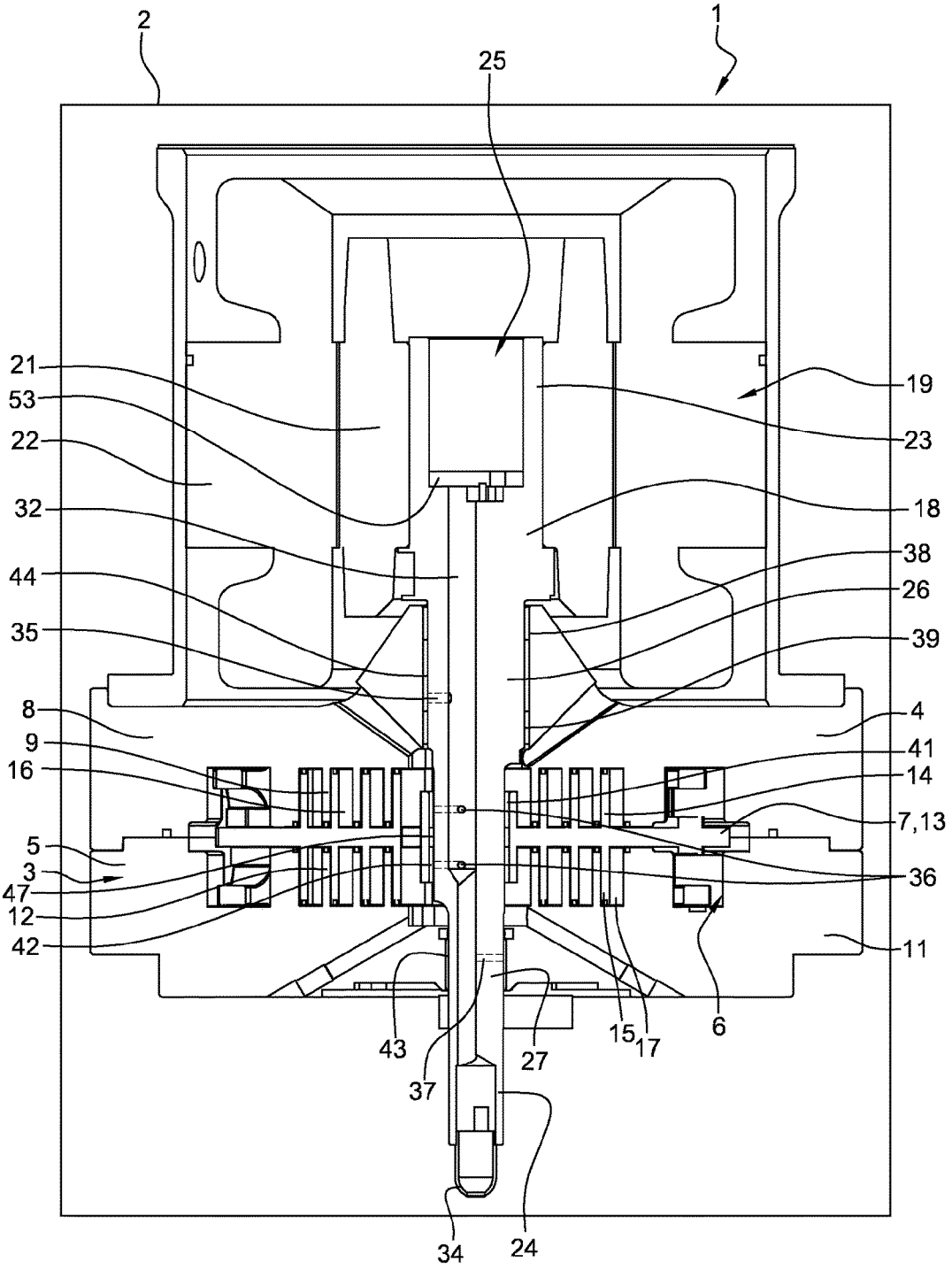
FIG. 1 is a longitudinal section view of a scroll compressor according to a first embodiment of the invention.
Figure 2:
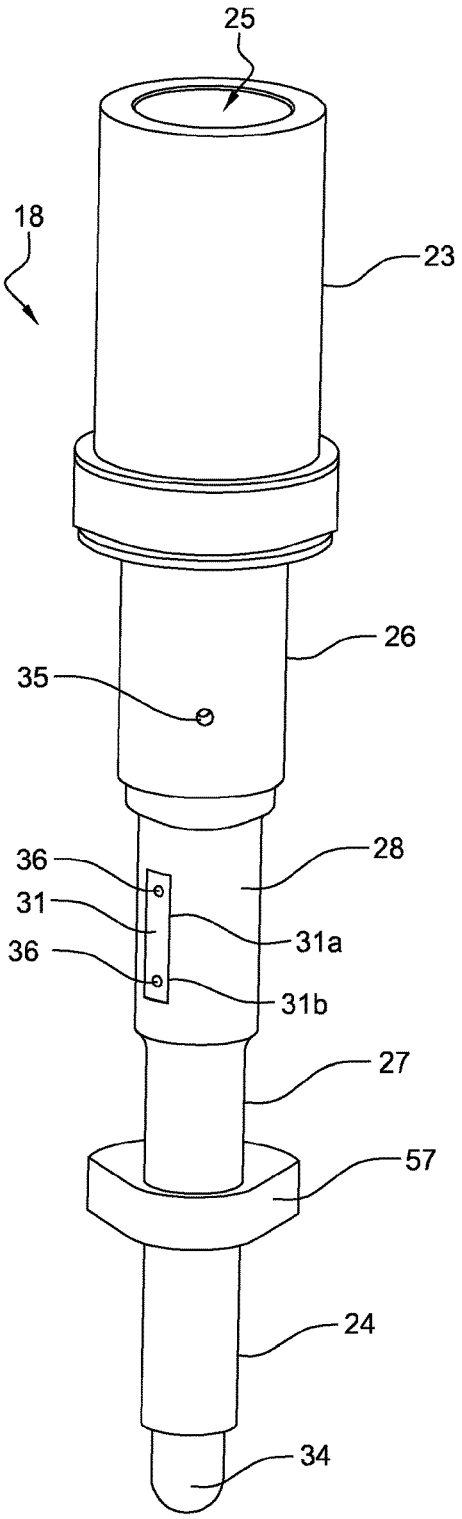
FIGS. 2 and 3 are perspective views of the drive shaft of the scroll compressor of FIG. 1.
Figure 3:
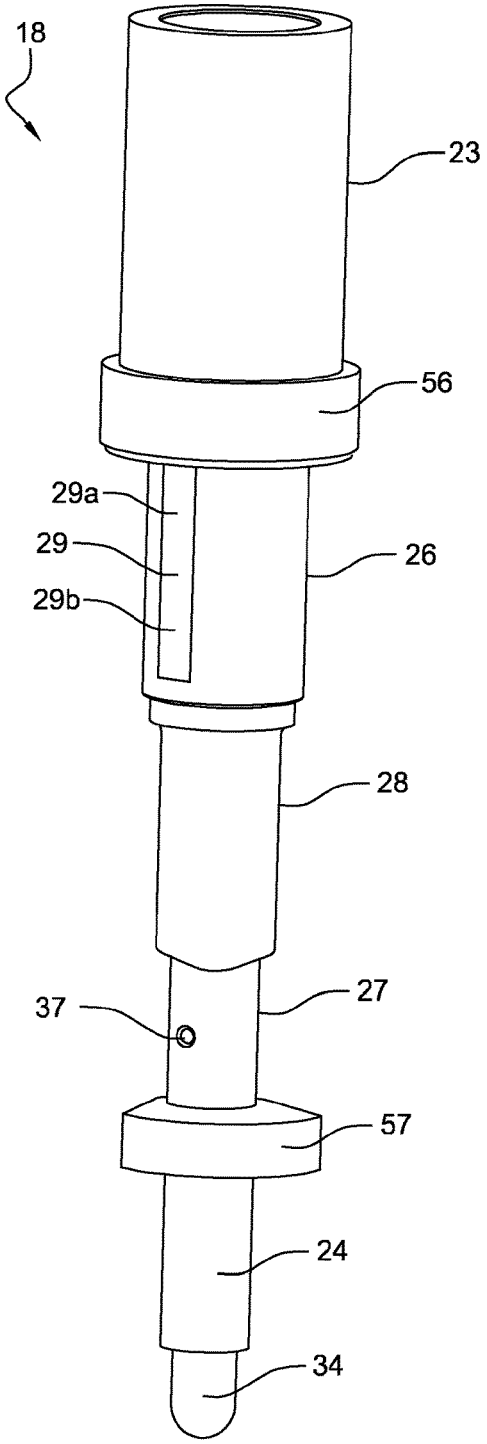
Figure 4:
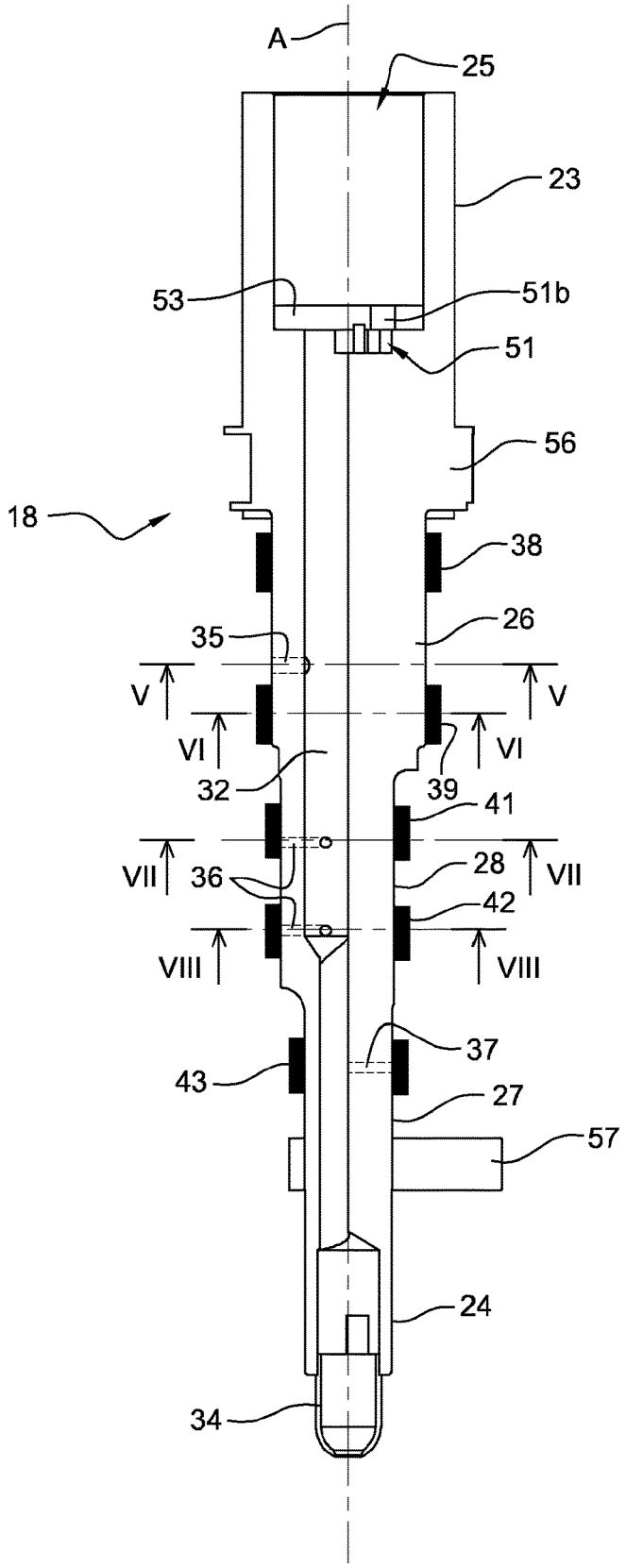
FIG. 4 is a longitudinal section view of the drive shaft of FIG. 2.
Figure 5:
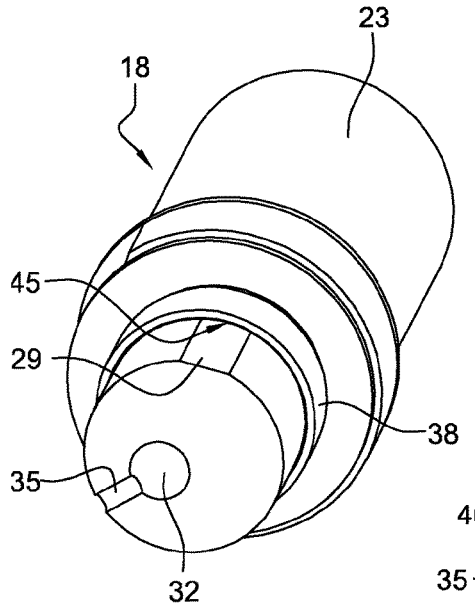
FIGS. 5 to 8 are partial perspective views, truncated respectively along planes V-V, VI-VI, VII-VII, VIII-VIII of FIG. 4, of the drive shaft of FIG. 2.
Figure 6:
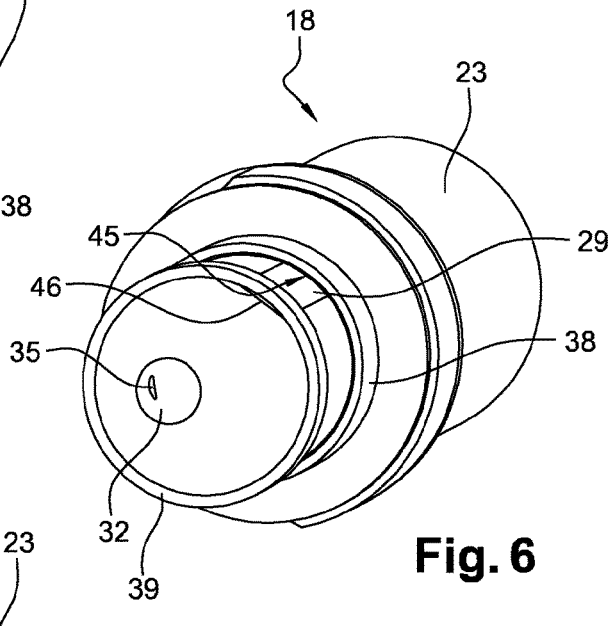
Figure 7:
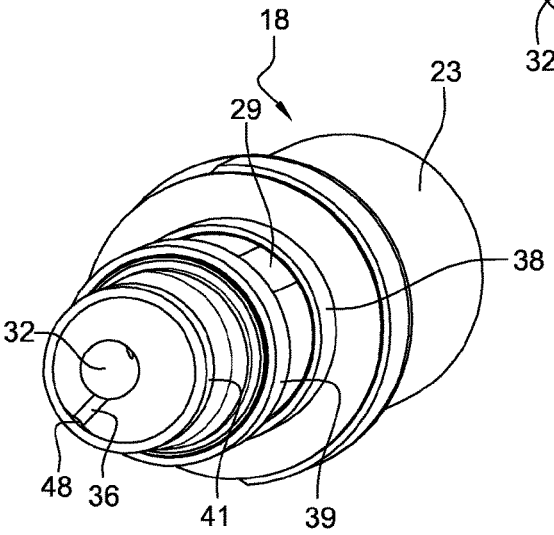
Figure 8:
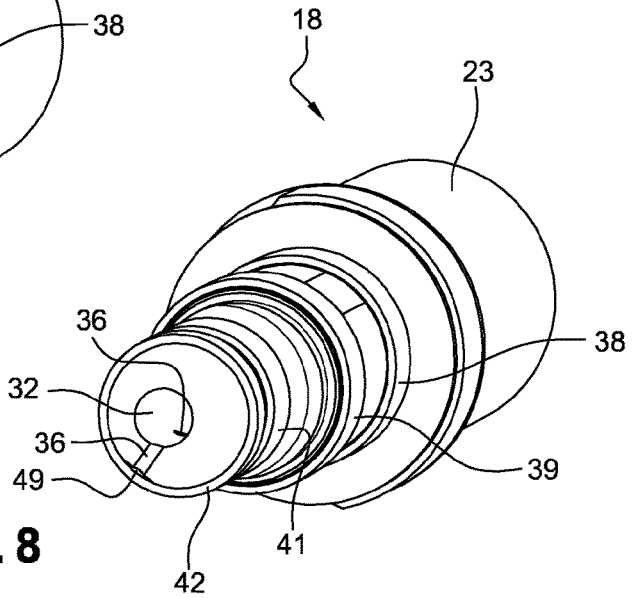

FIG. 1 shows a scroll compressor 1 occupying a vertical position.

The scroll compressor 1 includes a closed container 2 and a compression unit 3 disposed inside the closed container 2 and configured to compress refrigerant.

The compression unit 3 includes first and second fixed scrolls 4, 5 delimiting an inner volume 6. In particular the first and second fixed scrolls 4, 5 are fixed in relation to the closed container 2. The first fixed scroll 4 may for example be secured to the second fixed scroll 5. The compression unit 3 further includes an orbiting scroll arrangement 7 disposed in the inner volume 6.

The first fixed scroll 4 includes a base plate 8 and a spiral wrap 9 projecting from the base plate 8 towards the second fixed scroll 5, and the second fixed scroll 5 includes a base plate 11 and a spiral wrap 12 projecting from the base plate 11 towards the first fixed scroll 4.

The orbiting scroll arrangement 7 includes a base plate 13, a first spiral wrap 14 projecting from a first face of the base plate 13 towards the first fixed scroll 4, and a second spiral wrap 15 projecting from a second face of the base plate 13 towards the second fixed scroll 5, the second face being opposite to the first face such that the first and second spiral wraps 14, 15 project in opposite directions. The first and second fixed scrolls 4, 5 are respectively located above and below the orbiting scroll arrangement 7.

The first spiral wrap 14 of the orbiting scroll arrangement 7 meshes with the spiral wrap 9 of the first fixed scroll 4 to form a plurality of compression chambers 16 between them, and the second spiral wrap 15 of the orbiting scroll arrangement 7 meshes with the spiral wrap 12 of the second fixed scroll 5 to form a plurality of compression chambers 17 between them. Each of the compression chambers 16, 17 has a variable volume which decreases from the outside towards the inside, when the orbiting scroll arrangement 7 is driven to orbit relative to the first and second fixed scrolls 4, 5.

Furthermore the scroll compressor 1 includes a stepped drive shaft 18 configured to drive the orbiting scroll arrangement 7 in orbital movements, and a driving unit 19 coupled to the drive shaft 18 and configured to drive in rotation the drive shaft 18 about a rotation axis A. The driving unit 19 includes an electric motor located above the first fixed scroll 4. The electric motor has a rotor 21 fitted on the drive shaft 18, and a stator 22 disposed around the rotor 21. For example, the electric motor may be a variable-speed electric motor.

The drive shaft 18 extends vertically across the base plate 13 of the orbiting scroll arrangement 7. The drive shaft 18 comprises a first end portion 23 located above the first fixed scroll 4 and on which is fitted the rotor 21, and a second end portion 24 opposite to the first end portion 23 and located below the second fixed scroll 5. The first end portion 23 has an external diameter larger than the external diameter of the second end portion 24. The first end portion 23 includes a central recess 25 emerging in an end face of the first end portion 23 opposite to the second end portion 24.

The drive shaft 18 further includes a first guided portion 26 and a second guided portion 27 located between the first and second end portion 23, 24, and an eccentric driving portion 28 located between the first and second guided portions 26, 27 and being off-centered from the rotation axis A of the drive shaft 18. The eccentric driving portion 28 is arranged to cooperate with the orbiting scroll arrangement 7 so as to cause the latter to be driven in an orbital movement relative to the first and second fixed scroll 4, 5 when the electric motor is operated.

The drive shaft 18 further includes a first outer flat part 29 extending along an outer surface of the first guided portion 26, and a second outer flat part 31 extending along on outer surface of the eccentric driving portion 28. Advantageously, the first and second outer flat parts 29, 31 extend substantially parallely to the rotation axis A of the drive shaft 18. The first and second outer flat parts 29, 31 may be angularly offset from each other relative to the rotation axis A of the drive shaft 18, and for example substantially diametrically opposite to each other.

The drive shaft 18 further includes a lubrication channel 32 extending over a part of the length of the drive shaft 18 and arranged to be supplied with oil from an oil sump defined by the closed container 2, by an oil pump 34 driven by the second end portion 24 of the drive shaft 18.

According to the first embodiment shown on FIGS. 1 to 10, the lubrication channel 32 is substantially parallel to the rotation axis A of the drive shaft 18 and offset, i.e. off-centered, from the rotation axis A of the drive shaft 18. However, according to another embodiment of the invention, the lubrication channel 32 may be inclined relative to the rotation axis A of the drive shaft 18.

According to the first embodiment shown on FIGS. 1 to 10, the oil pump 34 is made of a pump element having a substantially cylindrical connecting portion connected to the second end portion 24 of the drive shaft 18 and an end portion having a curved shape and provided with an oil opening. However, according to another embodiment of the invention, the oil pump 34 may be made of the second end portion 24 of the drive shaft 18.

The drive shaft 18 also includes a lubrication hole 35 fluidly connected to the lubrication channel 32 and emerging in an outer wall of the first guided portion 26 of the drive shaft 18, a two lubrication holes 36 fluidly connected to the lubrication channel 32 and emerging in an outer wall of the eccentric driving portion 28 of the drive shaft 18, and a lubrication hole 37 fluidly connected to the lubrication channel 32 and emerging in an outer wall of the second guided portion 27 of the drive shaft 18. Advantageously, each lubrication hole extends substantially radially relative to the rotation axis A of the drive shaft 18.

The scroll compressor 1 further includes bearing elements configured to engage the drive shaft 18. The bearing elements includes two stationary bearings 38, 39 each provided between the first fixed scroll 4 and the first guided portion 26 of the drive shaft 18, two orbiting bearings 41, 42 each provided between the orbiting scroll arrangement 7 and the eccentric driving portion 28 of the drive shaft 18, and one stationary bearing 43 provided between the second fixed scroll 5 and the second guided portion 27 of the drive shaft 18. It should be noted that the bearings 38, 39, 41, 42, 43 are located on a same side of the drive shaft 18 in relation to the first end portion 23.

The stationary bearings 38, 39, the drive shaft 18 and the first fixed scroll 4 define a first annular gap 44 in which emerges the lubrication hole 35. Further the first outer flat part 29, which extends along the first guided portion 26 of the drive shaft 18, includes a first outer surface portion 29*a* extending along the stationary bearing 38, and a second outer surface portion 29*b* extending along the stationary bearing 39. The first outer surface portion 29*a* and the stationary bearing 38 define a first oil recess 45 fluidly connected to the first annular gap 44, and the second outer surface portion 29*b* and the stationary bearing 39 define a second oil recess 46 fluidly connected to the first annular gap 44.

The orbiting bearings 41, 42, the drive shaft 18 and the second fixed scroll 5 define a second annular gap 47. Further the second outer flat part 31, which extends along the eccentric driving portion 28 of the drive shaft 18, includes a third outer surface portions 31*a* extending along the orbiting bearing 41, and a fourth outer surface portions 31*b* extending along the orbiting bearing 42. The third outer surface portion 31*a* and the orbiting bearing 41 define a third oil recess 48 fluidly connected to the second annular gap 47, and the fourth outer surface portion 31*b* and the orbiting bearing 42 define a fourth oil recess 49 fluidly connected to the second annular gap 47.

According to the first embodiment shown on FIGS. 1 to 10, the lubrication hole 35 emerges in an outer portion of the first guided portion 26 of the drive shaft 18 angularly offset from the first outer flat part 29 with respect to the rotation axis A of the drive shaft 18, and the lubrication holes 36 emerge in the second outer flat part 31.

The drive shaft 18 further includes a vent channel 51 fluidly connected on the one hand to the lubrication channel 32 and on the other hand to the central recess 25 of the first end portion 23 of the drive shaft 18.

Figure 9:
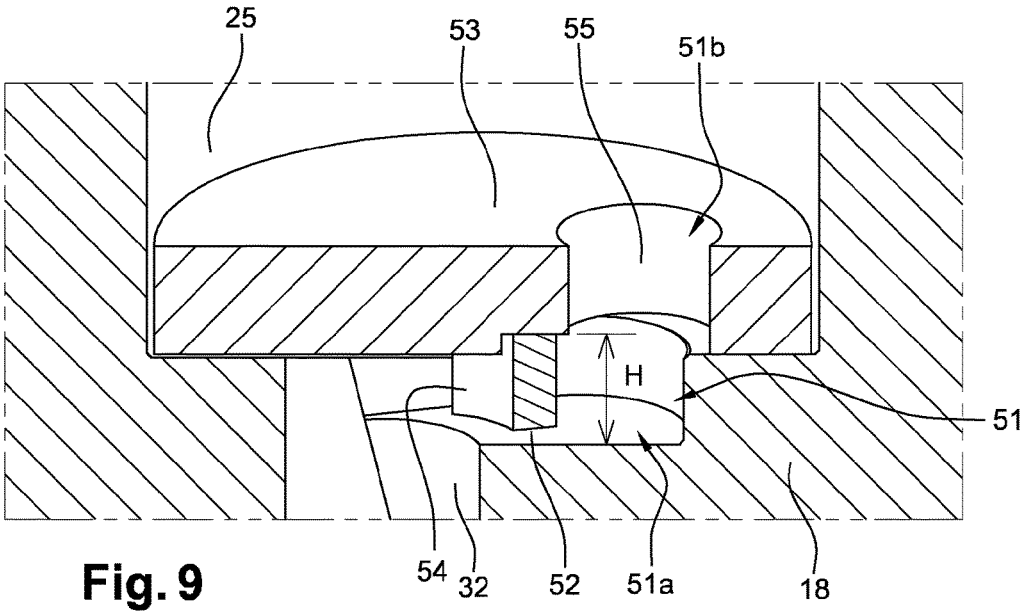
FIG. 9 is a partial perspective view, truncated along a longitudinal plane, of the drive shaft of FIG. 2.
Figure 10:
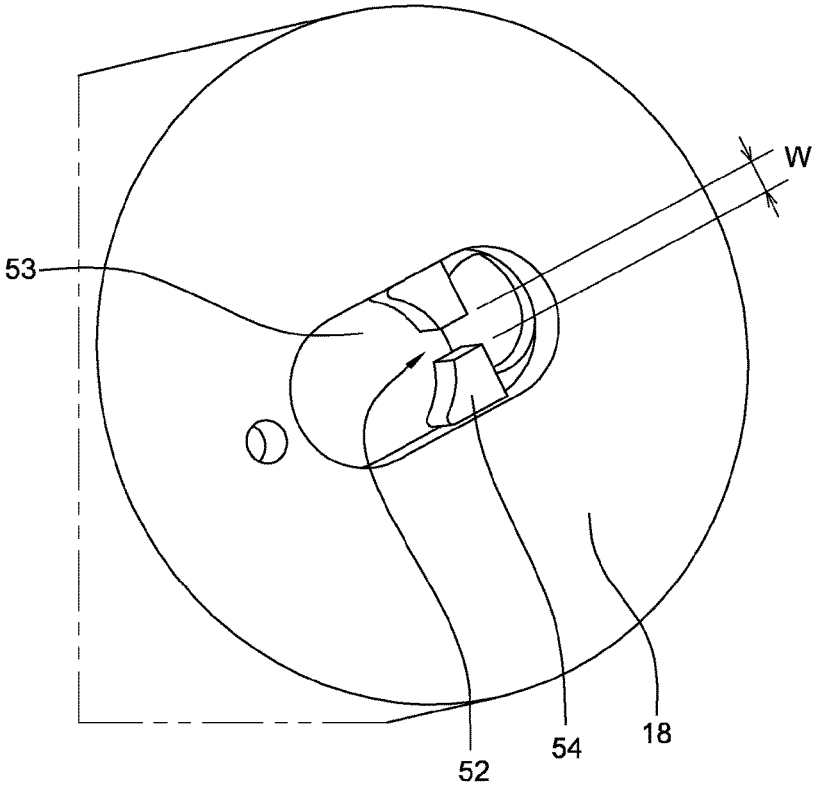
FIG. 10 is a partial perspective view, truncated along a transverse plane, of the drive shaft of FIG. 2.

As better shown on FIG. 9, the vent channel 51 includes a first vent portion 51*a* extending substantially radially relative to the rotation axis A of the drive shaft 18, and a second vent portion 51*b* located downstream the first vent portion 51*a* and extending substantially parallelly to the rotation axis A of the drive shaft 18. According to the first embodiment of the invention, the first vent portion 51*a* emerges in a inner wall portion of the lubrication channel 32 located nearby the rotation axis A of the drive shaft 18, and the second vent portion 51*b* is opposite to the lubrication channel 32 with respect to the rotation axis A of the drive shaft 18. The location of the second vent portion 51*b* is advantageously opposite to the inner wall portion of the lubrication channel 32 along which the oil flows by centrifugation during the rotation of the drive shaft 18.

The vent channel 51 further includes a flow restriction area 52 provided on the first vent portion 51*a* and configured to radially restrict the flow cross-section of the first vent portion 51*a*. The first vent portion 51*a* may include a first section provided upstream the flow restriction area 52 and a second section provided downstream the flow restriction area 52. Further, the flow restriction area 52 may be located nearby an inner wall portion of the lubrication channel 32. According to an embodiment of the invention, the flow restriction area 52 may be substantially centered with respect to rotation axis A of the drive shaft.

Advantageously, the flow restriction area 52 is configured such that, at the flow restriction area 52, a width W of the flow cross-section of the first vent portion 51*a* is smaller than a height H of the flow cross-section of the first vent portion 51*a*.

The drive shaft 18 further includes a closure member 53 located in the central recess 25 of the first end portion 23, and configured to close an end portion of the lubrication channel 32 and to partially define the vent channel 51.

The closure member 53 includes a restriction member 54 configured to partially define the flow restriction area 52, and a vent hole 55 forming the second vent portion 51*b* of vent channel 51.

The scroll compressor 1 further includes a first counterweight 56 and a second counterweight 57 connected to the drive shaft 18, and arranged to balance the mass of the orbiting scroll arrangement 7. The first counterweight 56 is located above the first fixed scroll 4, and the second counterweight 57 is located below the second fixed scroll 5.

According to the first embodiment shown on FIGS. 1 to 10, the first counterweight 56 and the drive shaft 18 are formed as a one-piece element, and the second counterweight 57 is distinct from the drive shaft 18 and is attached to the latter. For example, the first counterweight 56 may be formed by removing material from the drive shaft 18.

The scroll compressor 1 also includes a refrigerant suction inlet (not shown in the figures) communicating with the inner chamber 6 to achieve the supply of refrigerant to the compression unit 3, and a discharge outlet (not shown in the figures) for discharging the compressed refrigerant outside the scroll compressor 1.

In operation, the oil supplied to the lubrication channel 32 by oil pump 34, flows by centrifugation along the inner wall portion of the lubrication channel 32 opposite to the rotation axis A of the drive shaft 18. A first part of the oil supplied to the lubrication channel 32 enters the lubrication hole 37 and lubricates the stationary bearing 43. A second part of the oil supplied to the lubrication channel 32 enters the lubrication holes 36 and the third and fourth oil recesses 48, 49, and then lubricates the orbiting bearing 41, 42. A third part of the oil supplied to the lubrication channel 32 enters successively the lubrication hole 35, the first annular gap 44 and the first and second oil recesses 45, 46, and then lubricates the stationary bearings 38, 39.

Further the vent channel 51 ensures the degassing of the oil circulating in the lubrication channel 32, and particularly the discharge of the refrigerant originating from the degassing outside the drive shaft 18. The flow restriction area 52 prevents or at least limits the oil discharge, or oil leaks, through the vent channel 51, even when the quantity of oil in the lubrication channel 32 is particularly considerable.

Figure 11:
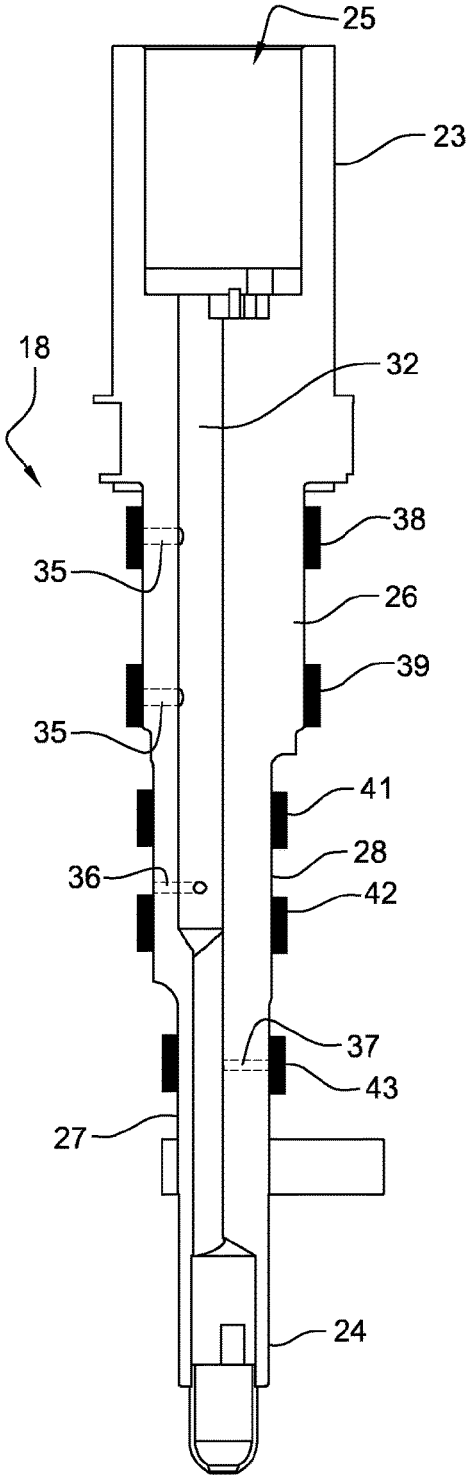
FIG. 11 is a longitudinal section view of the drive shaft of a scroll compressor according to a second embodiment of the invention.

FIG. 11 represents the drive shaft 18 of a scroll compressor 1 according to a second embodiment of the invention which differs from the first embodiment in that the drive shaft 18 includes two lubrication holes 35 emerging respectively in the first and second outer surface portions 29*a*, 29*b* of the first outer flat part 29, and only one lubrication hole 36 emerging in the second annular gap 47. According to said second embodiment of the invention, the lubrication hole 36 may emerge in an outer portion of the eccentric driving portion 28 of the drive shaft 18 angularly offset from the second outer flat part 31 with respect to the rotation axis A of the drive shaft 18.

Figure 12:
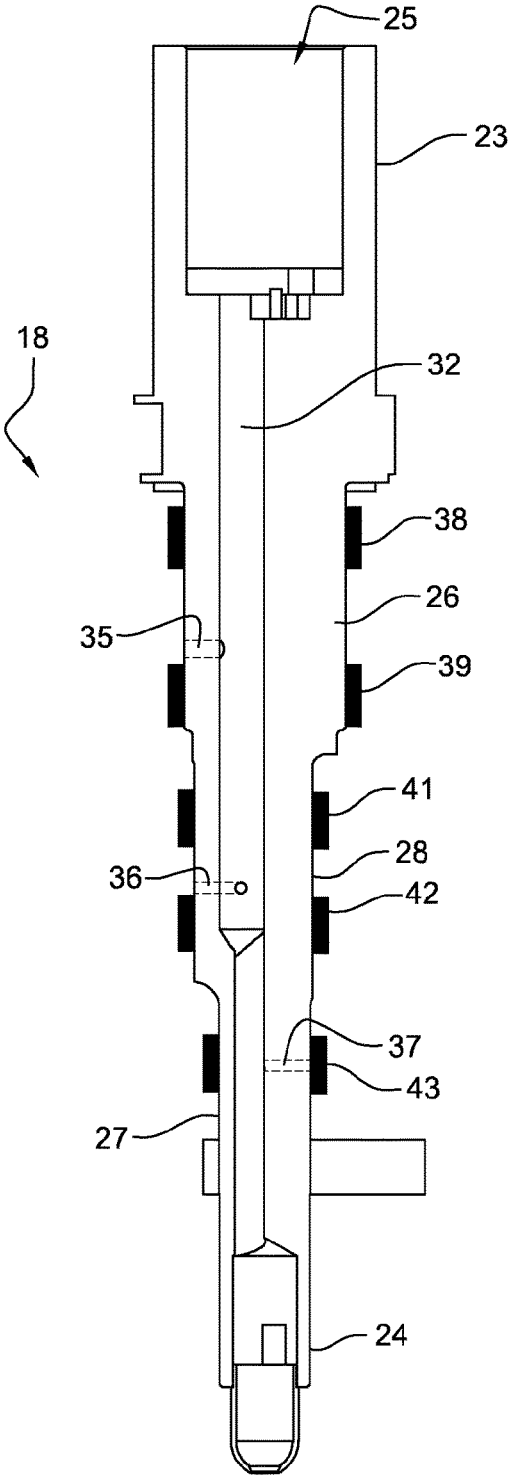
FIG. 12 is a longitudinal section view of the drive shaft of a scroll compressor according to a third embodiment of the invention.

FIG. 12 represents the drive shaft 18 of a scroll compressor 1 according to a third embodiment of the invention which differs from the first embodiment in that the drive shaft 18 includes only one lubrication hole 36 emerging in the second annular gap 47. According to said second embodiment of the invention, the lubrication hole 36 may emerge in an outer portion of the eccentric driving portion 28 of the drive shaft 18 angularly offset from the second outer flat part 31 with respect to the rotation axis A of the drive shaft 18.

Of course, the invention is not restricted to the embodiments described above by way of non-limiting examples, but on the contrary it encompasses all embodiments thereof.

What is claimed is:

1. A scroll compressor including at least:

a compression unit configured to compress refrigerant and including at least a first fixed scroll and an orbiting scroll arrangement, a drive shaft configured to drive the orbiting scroll arrangement in an orbital movement, the drive shaft including at least:

a lubrication channel configured to be supplied with oil from an oil sump and extending over at least a part of a length of the drive shaft, and a first lubrication hole fluidly connected to the lubrication channel and emerging in an outer wall of the drive shaft, a driving unit coupled to the drive shaft and arranged for driving in rotation the drive shaft about a rotation axis (A), a first and a second bearings axially spaced apart along the rotation axis of the drive shaft and each configured to engage the drive shaft, wherein a space between the first and second bearings and around the drive shaft at least partially defines a first annular gap, the first lubrication hole emerges in the first annular gap, the first bearing and the drive shaft define a first oil recess fluidly connected to the first annular gap, and the second bearing and the drive shaft define a second oil recess fluidly connected to the first annular gap.

2. The scroll compressor according to claim 1, wherein the drive shaft further includes a first and a second outer surface portions flat and facing respectively the first and second bearings, the first outer surface portion and the first bearing defining the first oil recess, and the second outer surface portion and the second bearing defining the second oil recess.

3. The scroll compressor according to claim 2, wherein the drive shaft includes a first outer flat part forming the first and second outer surface portions, the first outer flat part further extending along the first annular gap.

4. The scroll compressor according to claim 3, wherein the first lubrication hole is angularly offset from at least one of the first and second outer surface portions with respect to the rotation axis of the drive shaft.

5. The scroll compressor according to claim 3, wherein the first lubrication hole is aligned with the first and second outer surface portions in a direction extending parallelly to the rotation axis of the drive shaft.

6. The scroll compressor according to claim 3, wherein the lubrication channel is offset from the rotation axis of the drive shaft, the first lubrication hole emerging in a first inner wall portion of the lubrication channel opposite to the rotation axis of the drive shaft.

7. The scroll compressor according to claim 2, wherein the first lubrication hole is angularly offset from at least one of the first and second outer surface portions with respect to the rotation axis of the drive shaft.

8. The scroll compressor according to claim 7, wherein the lubrication channel is offset from the rotation axis of the drive shaft, the first lubrication hole emerging in a first inner wall portion of the lubrication channel opposite to the rotation axis of the drive shaft.

9. The scroll compressor according to claim 2, wherein the first lubrication hole is substantially aligned with the first and second outer surface portions in a direction extending parallelly to the rotation axis of the drive shaft.

10. The scroll compressor according to claim 2, wherein the lubrication channel is offset from the rotation axis of the drive shaft, the first lubrication hole emerging in a first inner wall portion of the lubrication channel opposite to the rotation axis of the drive shaft.

11. The scroll compressor according to claim 1, wherein the lubrication channel is offset from the rotation axis of the drive shaft, the first lubrication hole emerging in a first inner wall portion of the lubrication channel opposite to the rotation axis of the drive shaft.

12. The scroll compressor according to claim 1, wherein the first and second bearings are each configured to further engage one of the first fixed scroll and the orbiting scroll arrangement.

13. The scroll compressor according to claim 1, wherein the drive shaft further includes a vent channel fluidly connected to the lubrication channel.

14. The scroll compressor according to claim 13, wherein the vent channel includes a flow restriction area configured to restrict a flow cross-section of the vent channel.

15. The scroll compressor according to claim 14, wherein the flow restriction area is configured such that, at the flow restriction area, a width of the flow cross-section of the vent channel is smaller than a height of the flow cross-section of the vent channel.

16. The scroll compressor according to claim 14, wherein the vent channel includes at least a first vent portion extending radially relative to the rotation axis (A) of the drive shaft, the flow restriction area being provided on the first vent portion.

17. The scroll compressor according to claim 16, wherein the vent channel includes a second vent portion located downstream the first vent portion and extending parallelly to the rotation axis of the drive shaft.

18. The scroll compressor according to claim 13, wherein the vent channel emerges in a second inner wall portion of the lubrication channel located nearby the rotation axis of the drive shaft.

19. The scroll compressor according to claim 13, wherein the drive shaft further includes a closure member configured to partially define the vent channel.

20. The scroll compressor according to claim 19, wherein the closure member includes a restriction member configured to partially define a flow restriction area.

* * * * *